US006910310B2

(12) United States Patent
Bower et al.

(10) Patent No.: US 6,910,310 B2
(45) Date of Patent: Jun. 28, 2005

(54) CHAIR RAIL SYSTEM AND METHOD

(75) Inventors: Clinton W. Bower, Coeur d'Alene, ID (US); Del Clark, Dalton Gardens, ID (US)

(73) Assignee: Braided Accents LLC, Coeur d'Alene, ID (US)

( * ) Notice: Subject to any disclaimer, the term of this patent is extended or adjusted under 35 U.S.C. 154(b) by 0 days.

(21) Appl. No.: 10/234,310

(22) Filed: Sep. 3, 2002

(65) Prior Publication Data

US 2004/0040250 A1 Mar. 4, 2004

(51) Int. Cl.[7] ..... E04C 2/38

(52) U.S. Cl. ..... 52/716.1; 52/717.01; 52/716.8; 52/718.01

(58) Field of Search ..... 52/716.1, 717.01, 52/716.8, 718.01, 718.02, 718.06, 204.57, 204.593, 204.595, 204.547, 204.6, 171.3, 286.1

(56) References Cited

U.S. PATENT DOCUMENTS

| | | | | | |
|---|---|---|---|---|---|
| 291,008 | A | | 12/1883 | Vogt | |
| 1,430,996 | A | | 10/1922 | Hörlin | |
| 1,869,081 | A | | 7/1932 | Schemmel | |
| 2,296,803 | A | | 9/1942 | Trew | |
| 2,678,476 | A | | 5/1954 | Carter | |
| 2,825,999 | A | * | 3/1958 | Dompieri | |
| 3,287,867 | A | * | 11/1966 | Aton | |
| 3,481,092 | A | | 12/1969 | Constantino | 52/288 |
| 4,112,195 | A | | 9/1978 | Pott et al. | 428/542 |
| 4,150,517 | A | | 4/1979 | Warner, Sr. | 52/288 |
| 4,736,559 | A | * | 4/1988 | Young | 52/311 |
| 5,261,204 | A | * | 11/1993 | Neff | 52/484 |
| D353,295 | S | * | 12/1994 | Bodine | D6/491 |
| 5,450,702 | A | * | 9/1995 | Barnett | 52/656.2 |
| 5,463,835 | A | | 11/1995 | Wood | 52/288.1 |
| 5,469,685 | A | * | 11/1995 | Nelson | 52/782.2 |
| 5,613,342 | A | * | 3/1997 | Nelson | 52/782.2 |
| 5,662,753 | A | | 9/1997 | Loos | 156/71 |
| 5,794,399 | A | * | 8/1998 | Searer | 52/718.01 |
| 5,894,701 | A | * | 4/1999 | Delorme | 52/801.11 |
| 6,604,331 | B1 | * | 8/2003 | Pallas et al. | 52/287.1 |

* cited by examiner

*Primary Examiner*—Jeanette Chapman
(74) *Attorney, Agent, or Firm*—Wells St. John P.S.

(57) ABSTRACT

A chair rail system is provided which includes a decorative cap rail and a plurality of base rails each having an undercut edge cooperating with the cap rail to provide a groove sized to receive an edge of a panel member, one of the base rails having an undercut edge dimensioned to receive a panel with a first thickness and another base rail having an undercut edge dimensioned to receive a panel with a second thickness greater than the first thickness. A method is also provided.

20 Claims, 3 Drawing Sheets

CHAIR RAIL SYSTEM AND METHOD

TECHNICAL FIELD

This invention pertains to architectural trim rails. More particularly, this invention relates to decorative chair rail systems.

BACKGROUND OF THE INVENTION

Chair rails have a history of being decorative as well as functional. Originally, chair rails were running lengths of wood that ran along a wall at the same height as the back of a chair. The chair rail, typically a couple of inches thick, functioned to protect the wall from damage caused by a chair hitting against the wall. As time progressed, decorative features were added to chair rails.

Today, chair rails are often used principally to provide a visual break in a room in order to impart decorative features. In some cases, chair rails have a groove along a back, bottom edge for mating with a panel, or wainscot. A wainscot comprises a panel that extends below a chair rail. In some cases, relatively thick panels having recesses therein are used. In other cases, tongue-and-groove boards join together to provide a decorative panel. In yet other cases, a relatively thin glass or board panel is used. In even other cases, a relatively thick, carved panel is used. However, it is necessary to first choose a panel in order to determine the thickness, and to then match a chair rail that has a properly sized groove along the bottom edge sized to overlap a given thickness of the chosen panel. Accordingly, distributors, vendors, and store owners are required to stock chair rails having multiple thickness grooves in order to provide customers with chair rails that can accept multiple wainscots having diverse thicknesses. Accordingly, there exists a need to reduce the requirement for distributors and vendors to stock multiple, decorative chair rails in order to enable mating with multiple unique wainscots.

SUMMARY OF THE INVENTION

A chair rail system is provided for enabling interchangeable and selective mating of a base molding within a chair rail system to enable mounting of the chair rail system to a unique one of multiple unique panel members, each having a unique thickness. Accordingly, a plurality of base rails are provided, each having a unique undercut edge dimension. One of the plurality of base rails is selected to match a dimensional thickness for a pre-selected panel member. Decorative features are imparted to the chair rail system by way of a cap rail which is affixed to the selected base rail. In this manner, a store owner or distributor only needs to stock a given unit quantity of decorative cap rail, which can be relatively expensive to form, and also stock multiple unique base rails so that a selected combination can be assembled to provide a desired chair rail system for a selected panel having a specific thickness.

According to one aspect, a chair rail system includes a decorative cap rail and a plurality of base rails. The plurality of base rails each has an undercut edge sized to receive an edge of a panel member. One of the base rails has an undercut edge dimension to receive a panel having a specific first thickness. Another of the base rails has an undercut edge dimension to receive a panel having a specific, second thickness that is greater than the first thickness.

According to another aspect, a chair rail system includes an ornamental molding apparatus including an ornamental cover strip and at least two base strips. The ornamental cover strip includes a raised decorative feature on a front face and a geometric fastening feature on a back face. The at least two base strips each include an undercut relief feature configured to overlap an edge of a panel member underlying thereunder. One of the base strips includes an undercut edge sized to receive a first wall panel having a first thickness and another of the base strips has an undercut edge sized to receive a second wall panel having a second thickness that is greater than the first thickness of the first wall panel.

According to yet another aspect, a method is provided for assembling a decorative chair rail molding system. The method includes: providing a decorative cap rail, a plurality of base rails each with an undercut lip sized with a unique depth, and a wall panel having a unique thickness; positioning the wall panel against a wall; selecting one of the base rails having an undercut lip depth sized to receive and overlay an edge of the wall panel; affixing the one base rail over the wall panel and to the wall; and affixing the decorative cap rail atop the one base rail.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

Figure 1:
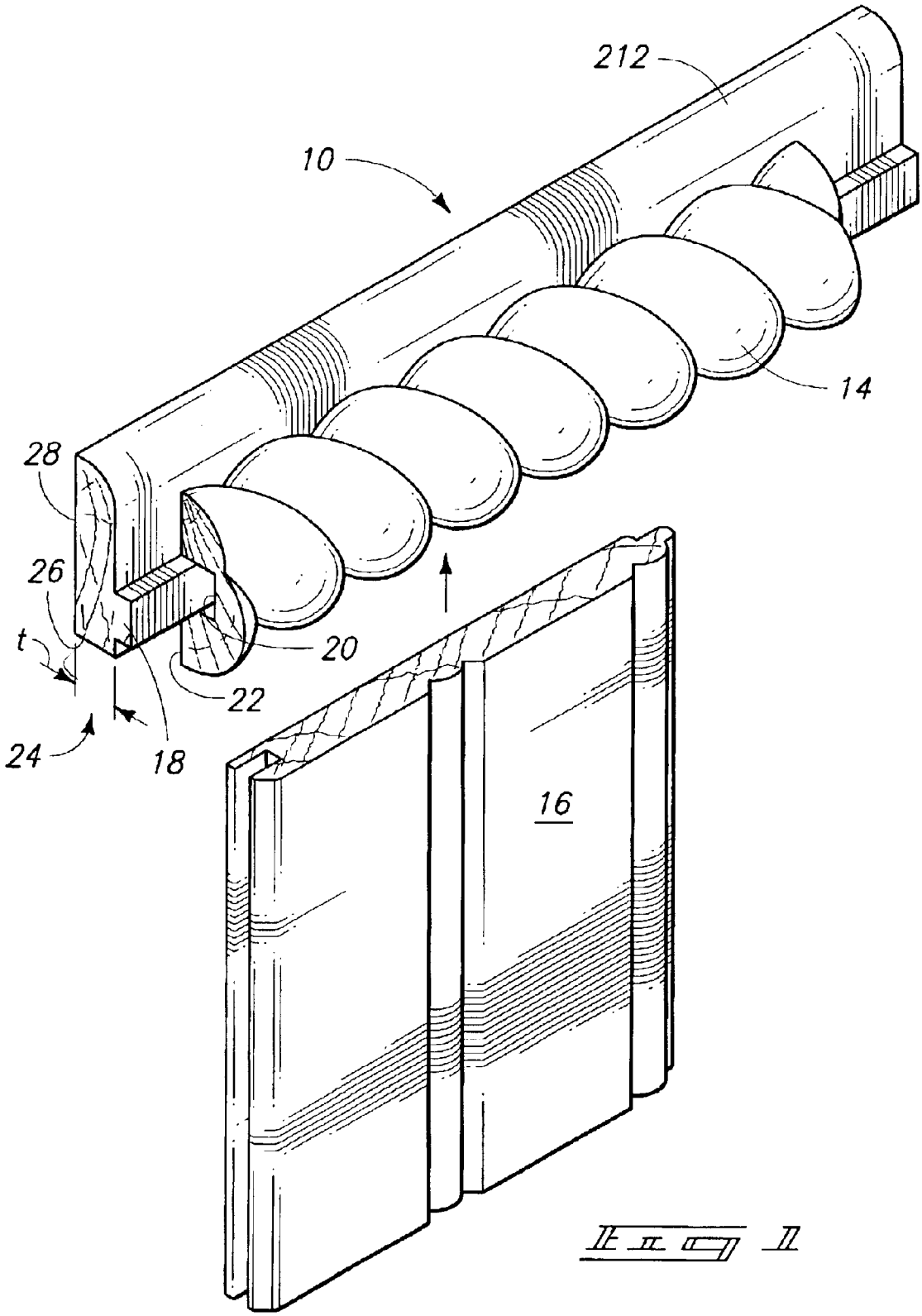
FIG. 1 is a perspective view illustrating assembly of a selectively assembled chair rail system being received onto a selected wainscot.

This disclosure of the invention is submitted in furtherance of the constitutional purposes of the U.S. Patent Laws "to promote the progress of science and useful arts" (Article 1, Section 8).

Reference will now be made to a preferred embodiment of Applicant's invention. An exemplary implementation is described below and depicted with reference to the drawings comprising a chair rail system identified by reference numeral 10. While the invention is described by way of a preferred embodiment, it is understood that the description is not intended to limit the invention to such embodiment, but is intended to cover alternatives, equivalents, and modifications which may be broader than the embodiment, but which are included within the scope of the appended claims.

In an effort to prevent obscuring the invention at hand, only details germane to implementing the invention will be described in great detail, with presently understood peripheral details being incorporated by reference, as needed, as being presently understood in the art.

The invention according to FIG. 1 comprises chair rail system 10, including a base rail, or molding, 212 and a decorative cap rail, or molding, 14. Base rail 212 includes a tongue 18 that is received into a complementary groove 20 on a back surface 22 of cap rail 14. Cap rail 14 is then secured atop base rail 212 via an adhesive and/or using fasteners, such as brads or screws. Alternatively, a tongue can be provided on cap rail 14 and a groove can be provided on base rail 212. Further alternatives include using any raised structure on one of the base rail 212 and cap rail 14 that interfits within a recess of the other of the base rail 212 and cap rail 14. Even further alternatively, cap rail 14 can have a flush back surface that is adhesively bonded, nailed, or screwed onto a similar flush front surface of base rail 212. According to one construction, base rail 212 is secured to a wall via fasteners such as nails that are driven through system 10 and tongue 18 into the wall. Cap rail 14 is then adhesively affixed onto base rail 212 in a manner that hides the fasteners or nails.

As used herein, the term "molding" is intended to refer generally to a decorative plane or curved strip that is used for ornamentation or finishing. Such decorative planes or curved strips can be formed of metal, wood, plaster, plastic, or some other material having sufficient structural stability. However, it is not necessary that a "molding" be formed by way of a molding process. Instead, the term "molding" is intended to include decorative planes or curved strips that can be formed by molding, milling, cutting, and various other techniques used for shaping such a decorative plane or curved strip.

As used herein, the term "wainscot" is intended to refer generally to a lining of a wall. In one case, the lining can be an interior wall. In other cases, "wainscot" in a more limiting sense refers to the lower two or three feet of an interior wall when finished differently from the remainder of the wall. The term "wainscot" also refers to a wall lining formed with paneling of any sort.

Cap rail 14 is mounted atop base rail 212 to extend below a bottom, or undercut, edge 26 of base rail 212 so as to provide a groove, or gap 20 having a thickness "t". Groove 24 is provided beneath inner surface 22. Inner surface 22 comprises an undercut surface that is provided along bottom edge 26 of chair rail assembly 10. A panel comprising a wainscot 16 is received beneath and against base rail 212, as well as underneath decorative cap rail 14.

When received atop base rail 212, decorative cap rail 14 and base rail 212 define a gap 24 having a thickness "t". Upon assembly, inner surface 22 of cap rail 14 overlays a top portion of wainscot 16 which is received between inner surface 22 and a wall (not shown) onto which a back surface 28 of base rail 212 is affixed.

Chair rail system 10 is configured to accommodate interchangeable versions of base rail 212 so as to provide a gap that has a desired dimension "t" that matches the thickness of a selected, desired panel (similar to panel 16). Gap 24 is provided with a depth "t" and an overlap sized to accommodate the selected panel. The panel 16 can be mounted to a wall by affixing base rail 212 into bottom edge abutment with a top edge 30 of the panel and then affixing cap rail 14 on top of base rail 212. Alternatively, cap rail 14 is affixed atop base rail 212, after which chair rail system 10 is mounted in overlap and atop the panel.

Figure 2:
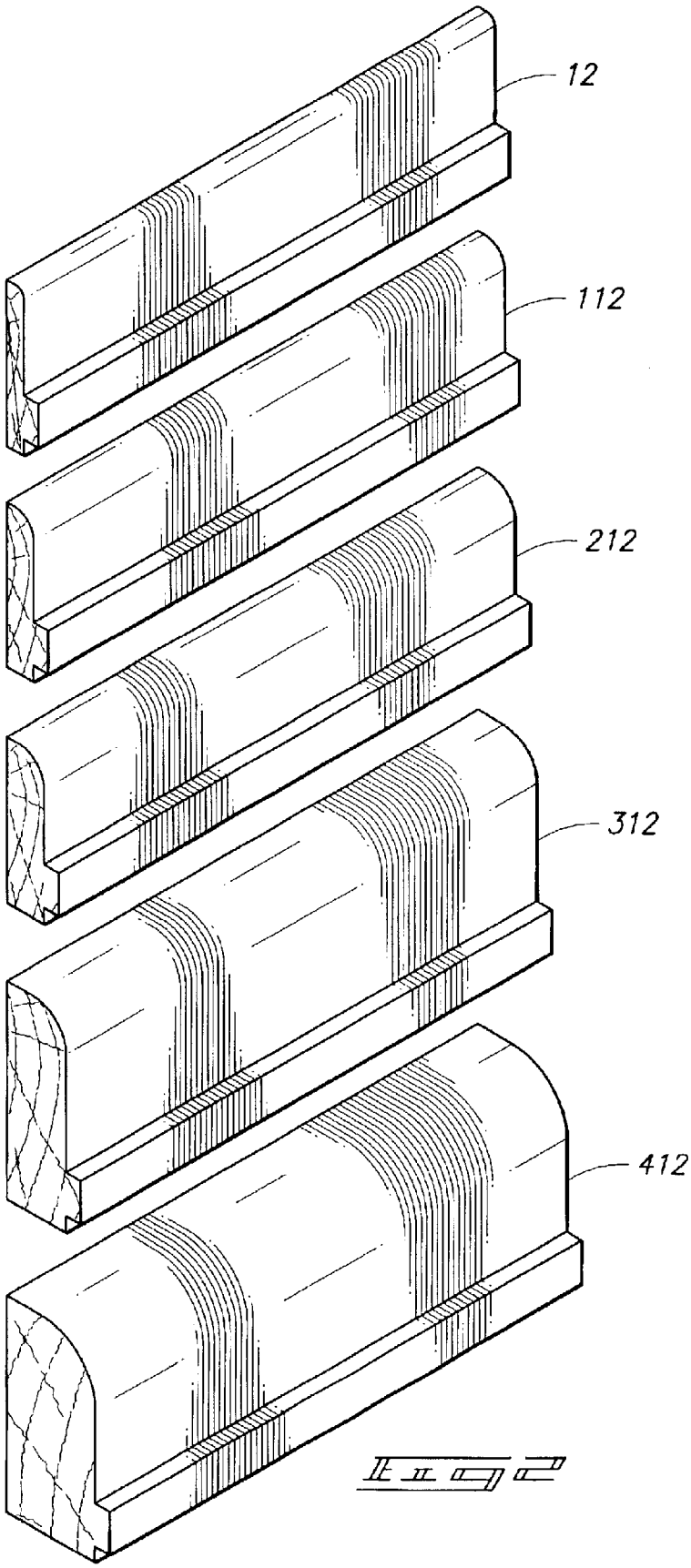
FIG. 2 is a perspective view illustrating a selection of chair rail base rails each having a unique thickness for receiving a correspondingly sized wainscot.

FIG. 2 illustrates a plurality of unique, interchangeable base rails 12, 112, 212, 312 and 412, each having a unique thickness "t" for bottom edge 26. More particularly, base rail 12 is configured to provide a gap that is sized, when assembled into the chair-rail system of FIG. 1, to receive a panel comprising a 3/16" glass sheet. For example, a glass sheet can be used to construct a wainscot for decorative and/or industrial applications where it is desirable to provide a sanitary surface that is easily cleaned, such as in a restaurant or public lavatory.

Base rail 112 is sized to provide a gap that is configured and dimensioned to receive a panel comprising a ¼" sheet of plywood. For example, a sheet of plywood having a veneer, such as a mahogany or birds-eye maple veneer, can be used with a chair rail system that includes base rail 112 in order to provide a second decorative wall feature.

Base rail 212 is sized to receive a panel 16 (see FIG. 1) comprising ⅜" wainscot formed by vertical tongue-and-groove boards. According to one construction, panel 16 (of FIG. 1) comprises a plurality of tongue-and-groove cedar boards that impart a third decorative wall feature.

Base rail 312 is sized to provide a gap to receive a panel comprising a ½" sheet panel. For example, base rail 312 is used in a chair rail system in order to accommodate use with a ½" sheet panel that imparts a fourth decorative wall feature.

Finally, base rail 412 is sized to provide a gap for receiving a panel comprising a ¾" raised wainscot. For example, base rail 412 is used in a chair rail system when a decorative, carved hardwood panel is used to provide a ¾" raised wainscot that imparts a fifth decorative wall feature.

Figure 3:
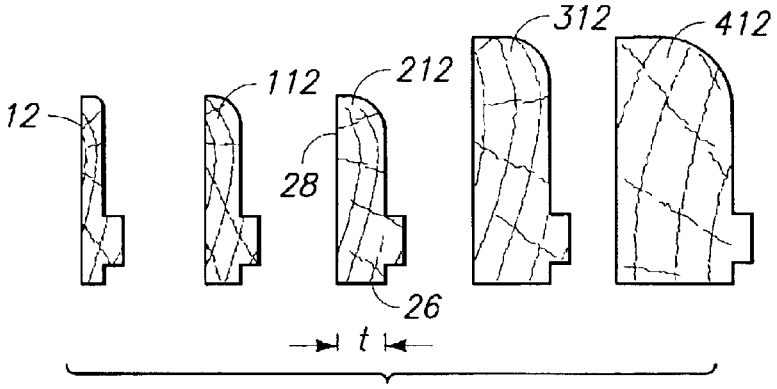
FIG. 3 is an end view of the selection of chair rail base rails of FIG. 2.

FIG. 3 further illustrates in end view the range of base rails of FIG. 2 that can be selectively used in the chair rail system of the present invention in order to accommodate wainscot of different thicknesses. As previously discussed, each base rail 12, 112, 212, 312, 412, and 512 has a unique thickness in order to accommodate a clearance dimension "t" for a pre-selected and desired wainscot, or wall panel.

Figure 4:
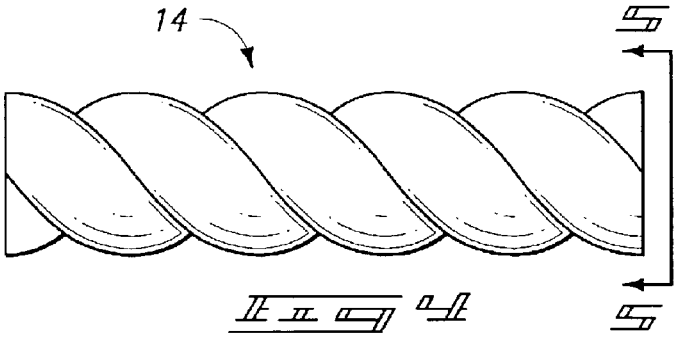
FIG. 4 is a plan view of a decorative cap rail of FIGS. 1 and 6.
Figure 5:
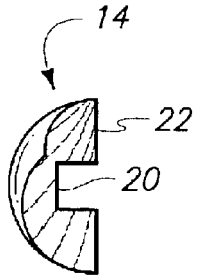
FIG. 5 is an end view of the decorative cap rail taken along line 5—5 of FIG. 4.

FIGS. 4 and 5 further illustrate features of decorative cap rail 14. In one form, decorative cap rail 14 comprises an elongate piece of hardwood that has been milled into the shape of a decorative twisted strand rope. More particularly, cap rail 14 is imparted with the shape of a rope segment along a front face. A back surface 22 of rail 14 comprises a flat surface extending vertically through a maximum diameter of a full section of rope being simulated by cap rail 14. Dovetail 19 is cut into the back surface 22 of cap rail 14.

The incorporation of highly decorative features into cap rail 14 can be relatively complicated and costly due to the complexity involved in milling geometric features such as a rope into a piece of wood. The provision of a rope cap rail feature into an elongate piece of hardwood is one such highly decorative feature. However, it is understood that a cap rail can incorporate other decorative features such as dentil blocks, strands of grape vines and grapes, chain links, egg and dart features, or other decorative features, including those having a repeating pattern.

In order to accommodate customers that want the ability to mount chair rails over multiple unique panel members, each with a unique thickness, requires the provision of a plurality of base rails, each with a unique undercut edge dimension. Pursuant to previously known techniques, a store owner would be required to stock multiple, unique chair rails, each having a relatively costly and complicated decorative face feature, such as a rope raised relief, or molding, and a unique undercut edge dimension. However, chair rail system 10 only requires that a store owner stock enough decorative cap rail to enable assembly onto a selected base rail having a desired undercut edge dimension.

According to previously known techniques, a store owner would be required to stock up to N times the number of decorative chair rails necessary for a particular job, where N represents the total number of unique thicknesses for a wall panel, or wainscot, being sold in a store. However, according to the present technique, there is a significant reduction in the amount of highly decorative and expensive rail components that needs to be held in inventory by a store owner in order to perform a particular sized job. Instead, the store owner is only required to stock extra lengths of each specifically-sized base rail. Since the base rails generally do not contain as much decorative detail, construction costs are relatively less, and the cost to stock multiple lengths of the specifically-sized base rails (versus stocking entire chair rails) is reduced.

Figure 6:
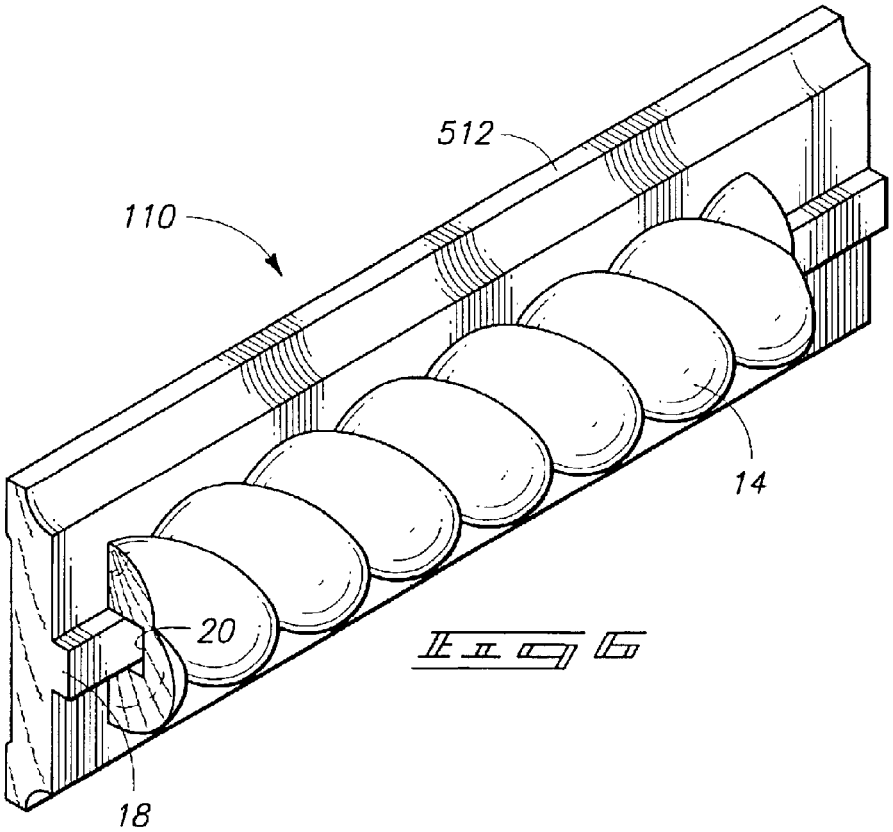
FIG. 6 is a perspective view of a chair rail system having a full-width chair rail base rail.

FIG. 6 illustrates an alternative configuration having a base rail 512 onto which decorative cap rail 14 is received. Base rail 512 differs in that there does not exist a gap for receiving a panel therebelow. Instead, base rail 512 is mounted directly onto a wall or panel support surface. Base rail 512 could be used to overlie an edge of a wallpaper border, similar to how wainscot is covered by chair rail system 10 of FIG. 1. However, base rail 512 does provide a base support structure for decorative cap rail 14 along with the top and bottom edges.

Chair rail system 110 (as well as system 10 of FIG. 1) can be imparted with numerous additional decorative features by forming cap rail 14 and base rail 512 from different materials which imparts further ornamental or decorative features. For example, cap rail 14 can be molded from a relatively dark strip of wood, such as teak or mahogany. Base rail 512 can be formed from a contrasting piece of relatively light wood such as holly. Accordingly, an additional ornamental aspect is imparted to chair rail system 110 by providing contrasting colors to the individual pieces comprising cap rail 14 and base rail 512. Such additional ornamental features can also be imparted to chair rail system 10 of FIG. 1. Further optional implementations can also be envisioned. The ability to remove the highly decorative component comprising cap rail 14 enables one to paint cap rail 14 without inadvertently painting base rail 512. Additionally, base rail 512 can be painted in a first color, while separated from cap rail 14, and cap rail 14 can be painted in a second color, after which the two are joined together.

Although the invention herein has been described by reference to a chair rail system, or molding, it is understood that more generally the present invention can be implemented as a wall rail system used along any portion of a wall, such as in the form of a crown molding, cove molding, base molding, or casing molding, in addition to a chair rail molding.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

The invention claimed is:

1. A chair rail system, comprising:

a decorative cap rail; and a plurality of base rails each having a vertical outer face configured to support the decorative cap rail and an undercut horizontal edge cooperating with the cap rail to provide a groove having a horizontal dimension sized to receive an edge of a panel member, one of the base rails having an undercut horizontal edge dimensioned to receive a vertical panel with a first thickness and another of the base rails having an undercut horizontal edge dimensioned to receive a vertical panel with a second thickness greater than the first thickness.

2. The chair rail system of claim 1 wherein one base rail has an undercut horizontal edge sized to support a cap rail so as to overlap a wainscot.

3. The chair rail system of claim 1 wherein the decorative cap rail comprises a rope decorative relief provided in assembly atop one of the base rails.

4. The chair rail system of claim 1 wherein the cap rail includes one of a tongue and a groove and the base rails include another of the tongue and the groove each configured to mate in complementary engagement with the one of the tongue and the groove of the cap rail.

5. The chair rail system of claim 1 wherein the base rails comprise an interchangeable system of base rails each having an undercut horizontal edge sized to cooperate with the cap rail to provide an underside relief groove with a horizontal dimension uniquely sized to overlap and receive a wall panel having a complementary edge thickness, wherein the system of base rails include relief grooves with a horizontal dimension incrementally sized progressively from a smaller horizontal dimension to a larger horizontal dimension.

6. The chair rail system of claim 1 wherein the base rail cooperates with the cap rail to form a flange that overlaps a panel so as to provide an undercut horizontal edge with a relief groove having a horizontal dimension uniquely sized to receive a wall panel with a complementary edge thickness.

7. The chair rail system of claim 1 further comprising a wall panel sized to be received beneath the undercut horizontal edge of a selected one of the base rails.

8. The chair rail system of claim 7 wherein the wall panel comprises a plurality of tongue-and-groove boards.

9. The chair rail system of claim 7 wherein the wall panel comprises a glass wall panel.

10. The chair rail system of claim 7 wherein the wall panel comprises a sheet panel.

11. The chair rail system of claim 7 wherein the wall panel comprises a sheet of plywood.

12. The chair rail system of claim 7 wherein the wall panel comprises a carved hardwood panel.

13. The chair rail system of claim 7 wherein the undercut horizontal edge on the base rail has a thickness substantially the same as a top-most edge thickness of a selected wall panel.

14. An ornamental molding apparatus, comprising:

an ornamental cover strip including a raised decorative feature on a front face and a geometric mounting feature on a back face; and at least two base strips each including a front face configured to receive the back face of the cover strip and an undercut edge extending perpendicular to the front face and configured to overlap an edge of a panel member having a complementary edge thickness underlying thereunder;

wherein the undercut edge of one of the base strips is sized to support the cover strip over a first wall panel having a first complementary thickness and the undercut edge of another of the base strips is sized to support the cover strip over a second wall panel having a second complementary edge thickness that is greater than the first complementary edge thickness of the first wall panel.

15. The apparatus of claim 14 wherein the ornamental cover strip comprises a decorative cap rail.

16. The apparatus of claim 14 wherein the decorative cap rail comprises a rope decorative relief raised elevationally on a front face of the cap rail.

17. The apparatus of claim 14 wherein the geometric fastening feature comprises at least one of a tongue and a groove, and wherein the ornamental cover strip includes one of the tongue and the groove and each of the plurality of base strips includes another of the tongue and the groove.

18. A method for assembling a decorative wall rail system, comprising:

providing a decorative cap rail, a plurality of base rails each with a front face for receiving the cap rail and an undercut lip extending perpendicular to the front face and sized with a unique depth, and a wall panel having an edge with a unique edge thickness;

positioning the wall panel against a wall with the edge thickness perpendicular to the wall;

selecting one of the base rails having an undercut lip sized relative to the edge thickness at the wall panel to cooperate in assembly with the cap rail to provide a complementary groove sized perpendicular to the wall so as to receive and overlay the edge of the wall panel;

affixing the one base rail over the wall panel and to the wall; and affixing the decorative cap rail atop the one base rail.

19. The method of claim 18 wherein one of the cap rail and the base rails comprises a tongue and another of the cap rail and the base rails comprises a groove, and wherein affixing the cap rail comprises nesting the tongue into the groove.

20. The method of claim 18 wherein affixing the cap rail occurs after affixing the base rail.

* * * * *